US005493091A

United States Patent [19]

Devautour et al.

[11] Patent Number: 5,493,091

[45] Date of Patent: Feb. 20, 1996

[54] HIGH VOLTAGE CIRCUIT BREAKER CONTACT STRUCTURE INCLUDING IONIZATION SLOT AND SECONDARY ARCING FEATURES

[75] Inventors: Joël Devautour, Saint Germain en Laye; Jean-Pierre Guery, Le Pecq; Hervé Lefebvre, Carrieres Sur Seine, all of France

[73] Assignee: Schneider Electric SA, Boulogne Billancourt, France

[21] Appl. No.: 252,211

[22] Filed: Jun. 1, 1994

[30] Foreign Application Priority Data

Jun. 2, 1993 [FR] France ..... 93 06597

[51] Int. Cl.[6] ..... H01H 33/18; H01H 9/30

[52] U.S. Cl. ..... 218/30; 218/31; 218/36; 218/40; 218/146; 218/148; 335/201

[58] Field of Search ..... ; 200/144 R, 144 C, 200/146 R, 147 R, 147 A, 147 B, 148 C, 237–249, 275, 261; 335/16, 132, 195–204; 218/16, 17, 18, 19, 30, 31, 34, 35, 36, 37, 38, 39, 40, 48, 49, 50, 146, 148; H01H 9/30, 33/20

[56] References Cited

U.S. PATENT DOCUMENTS

| | | | |
|---|---|---|---|
| 2,538,370 | 1/1951 | Lerstrup | 218/40 |
| 3,114,814 | 12/1963 | Stettner | 218/30 |
| 3,166,660 | 1/1965 | Gribble | 200/239 |
| 4,112,275 | 9/1978 | Kohler | 218/30 |
| 4,404,443 | 9/1983 | Goynel et al. | 218/23 |
| 4,429,198 | 1/1984 | Mori et al. | 218/149 |
| 4,612,427 | 9/1986 | Mori et al. | 218/148 |
| 4,642,428 | 2/1987 | Yoshiyasu et al. | 218/149 |
| 5,097,104 | 3/1992 | Weichert | 218/146 |

FOREIGN PATENT DOCUMENTS

| | | | |
|---|---|---|---|
| 2225069 | 10/1974 | France | H01H 9/46 |
| 2491676 | 4/1982 | France | H01H 50/54 |
| 2642567 | 8/1990 | France | H01H 9/30 |
| 2163293 | 2/1986 | United Kingdom | H01H 33/20 |

*Primary Examiner*—J. R. Scott

*Attorney, Agent, or Firm*—Oblon, Spivak, McClelland, Maier & Neustadt

[57] ABSTRACT

An electromechanical switch of the contactor or circuit-breaker type with adjacent contacts, which are provided on respective mobile and fixed contact parts. This arrangement defines a narrow ionization slot which is maintained at the start of contact opening in order to cause a secondary arc to fire substantially perpendicular to the contact opening direction constituting a shunting arc to eliminate the time duration of the contacts and switch legs.

14 Claims, 2 Drawing Sheets

HIGH VOLTAGE CIRCUIT BREAKER CONTACT STRUCTURE INCLUDING IONIZATION SLOT AND SECONDARY ARCING FEATURES

BACKGROUND OF THE INVENTION

1. Field of the Invention

The present invention concerns an arc switching electromechanical switch of the contactor or circuit-breaker type, and, more particularly, to a switch having a fixed contact and a mobile contact respectively disposed on a fixed conductive part and a mobile conductive part.

2. Description of the Prior Art

If a contactor is connected in series with a short-circuit protection device such as a circuit-breaker, for example, on the circuit supplying power to a load, an overcurrent can occur with the contactor contacts closed or virtually closed. Even if the fault current, then flowing through the contractor, is limited by the protection device, it is nevertheless very much greater than the nominal current that the contactor interrupts under normal circumstances. If the fault current causes electrodynamic opening of the contacts, the arc then generated can be accompanied by localized liquidation of the fixed and mobile contacts at the anode and cathode ends of the arc and, if it lasts more than 1 ms to 2 ms, can cause bonding or welding of the contacts when they close again.

To avoid this problem, special arc contacts have been used alongside the main contacts. Another solution is the provision of means for accelerating migration of the arc towards an arc extinction chamber.

An object of the present invention is a simple way of preventing stagnation of the arc generated between the contacts on normal or electrodynamic openings thereof, encouraging the striking and maintaining of a secondary arc.

SUMMARY OF THE INVENTION

In accordance with the invention, said fixed and mobile contact parts have respective first and second faces parallel or substantially parallel to said opening direction and said two faces are adjacent to said contacts and define between them in a contact closed position a narrow ionization slot, the width of said slot being maintained substantially constant at the beginning of contact opening in order to cause a secondary arc to fire substantially perpendicular to said opening direction.

The primary arc and the secondary arc co-exist briefly and the primary arc is extinguished very quickly whereas continued presence of the secondary arc is guaranteed by a sufficient length of the ionization slot. The width of the slot is advantageously less than the critical electrodynamic contact opening distance $e_c$, this distance being defined as that causing substantial liquidation of the contacts likely to bond or weld them when they close again. For a low-voltage switch the slot width is preferably between about 1 mm and 3 mm and the depth of the slot is determined accordingly, being preferably greater than its width.

The fixed ionization face is formed on the wall of a recess in a J-shape part of the fixed contact or attached thereto. A metal (for example steel) part carrying one of the ionization faces can be removably attached to the fixed or mobile contact part.

The following description of preferred embodiments of the invention given with reference to the drawings clearly indicates its features and advantages.

DETAILED DESCRIPTION OF THE PREFERRED EMBODIMENTS

Figure 1:
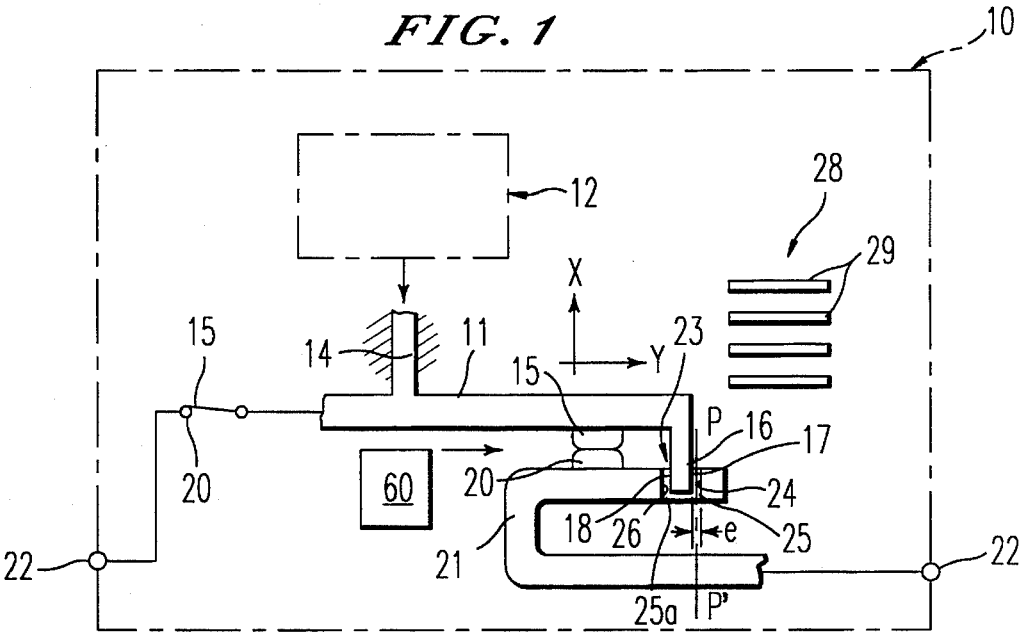
FIG. 1 is a schematic representation of a contactor with ionization means for accordance with the invention.
Figure 2:
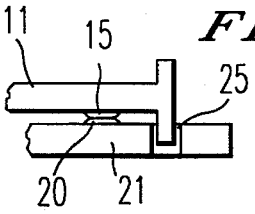
FIGS. 2 through 5 show various phases of the opening of the contacts of the FIG. 1 contactor.
Figure 3:
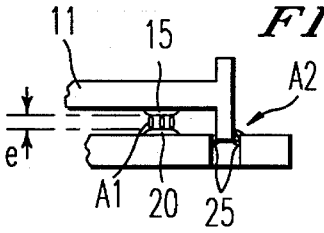

The contactor shown diagrammatically in FIG. 1 comprises a casing 10 and a contact bridge 11 for each pole mobile in the X direction. The contact bridge is displaced by an actuator device 12 conventionally known, in one direction by electromagnetic or manual action and in the other direction by a return spring, for example. The contact bridge or its mobile support is guided by fixed guide surfaces 14 providing a small clearance in the direction Y, perpendicular to X, and providing a small clearance for rotation about the direction X.

The contact bridge 11 carries near each end a mobile contact pad 15 and at each end a right-angle upstand or finger 16 having two opposite sides 17, 18 parallel to the opening direction X.

Each mobile contact pad 15 cooperates with a fixed contact pad 20 carried by a fixed contact support 21 connected to a connecting terminal 22. The conductive support 21 has a J-shape in this embodiment to facilitate displacement in the direction Y of the arc generated between the contacts when they open. The usual means for blowing the arc in the direction Y are shown schematically at 60 and may be any of the conventional devices. Only the righthand half-bridge is shown in full in FIG. 1.

The fixed contact support 21 has a recess or well 23 in which the finger 16 penetrates when the contacts are closed. The surface 17 of the finger 16 facing away from the contacts defines, with the facing surface 24 of the recess, an ionization slot 25. The width e of the slot 25 is preferably between 1 mm and 3 mm and its median plane P-P' is parallel to the opening direction X. The surface 18 of the finger 16 near the contact defines, with the facing surface 26 of the recess 23, and ionization slot 25*a* communicating with the slot 25 and whose width e' is greater than that of the slot 25 to generate a secondary arc between the finger 16 and the surface 24 to shunt the primary arc and reduce the time duration of the primary arc. The length 1 of the finger 16 is between 5 mm and 8 mm to determine a substantial depth h of slot and thereby to maintain the presence of the ionization slot for a sufficient time period. The depth h of the slot is in all cases greater than its width. It is preferable that the finger 16 and the ionization slot 25 be in the immediate proximity of the contact pads 15, 20 so that the plasma generated by the initial arc between the contacts can propagate quickly toward the slot.

Figure 6:
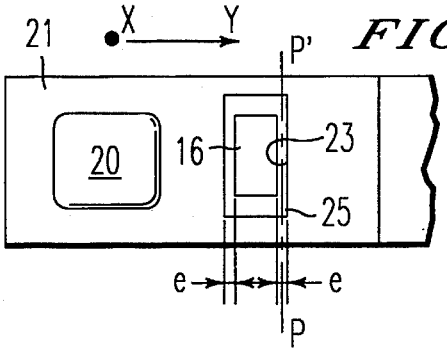
FIG. 6 is a top view of part of the fixed contact part.
Figure 7:
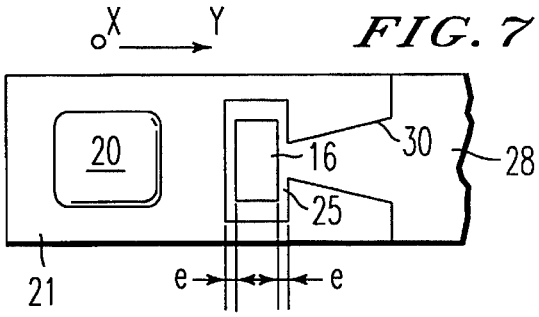
FIG. 7 similarly shows a variant fixed contact part.

The recess 28 can have a closed contour (FIG. 6) or an open contour (FIG. 7) and in the latter case it advantageously communicates with an interrupter chamber 28 with arc-splitter plates 29 through an opening 30 in the support 21 extending in the Y direction.

Figure 8:
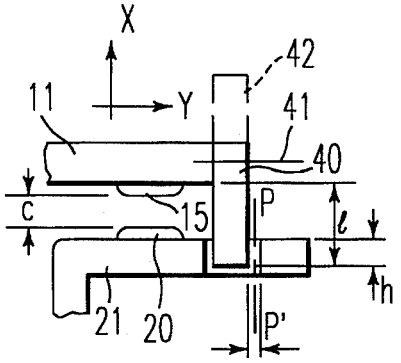
FIGS. 8 through 10 show other embodiments of the ionization slot.

The finger 16 can be on a metal wear part 40 replaceably attached to the contact bridge by fixing means 41 (FIG. 8). This part can be of copper but is preferably of steel. The finger can instead be an extension of an arc horn 42 shown in dashed line in FIG. 8 so that the secondary arc fired struck in the ionization slot, can migrate in the X direction along the part 40 as far as the upper part of the horn 42.

Figure 9:
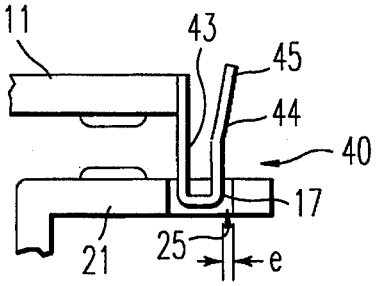

FIG. 9 shows that the attached metal part 40 can be U-shape with one branch 43 fixed to the contact bridge and the other branch 44 defining firstly the face 17 of the ionization slot and secondly an arc horn 45.

Figure 10:
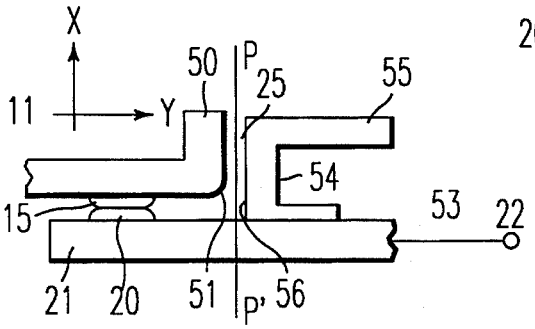

The FIG. 10 embodiment is advantageous because of its compact overall size and comprises a flat fixed contact support 21. The mobile contact bridge 11 has an upstand 50 at each end oriented in the contact opening direction, like a conventional arc horn, but so that it has a face 51 parallel to the direction X. An interchangeable metal switching part 53 is fixed to the flat support 21 by fixing means 52; the part 53 has a J-shape, L-shape or U-shape and has one branch 54 parallel to the X direction and one branch 55 oblique or parallel to the Y direction. The branch 54 has a surface 56 parallel to X to define (with the face 51) the ionization slot of constant width e between approximately 1 mm and 3 mm and is joined directly at right angles to the fixed contact support 21. The portion of the part 53 through which the arc current flows is entirely on the opposite side of the median plane P–P' of the ionization slot 25 to the contact pads.

Figure 4:
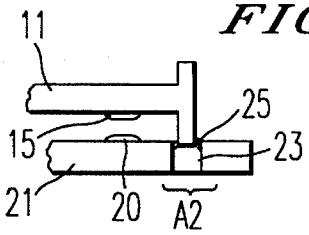
Figure 5:
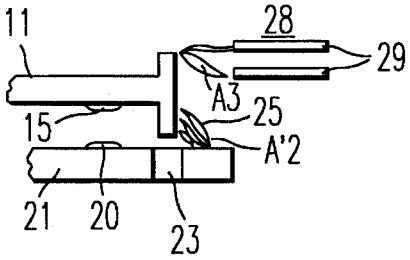
Figure 12:
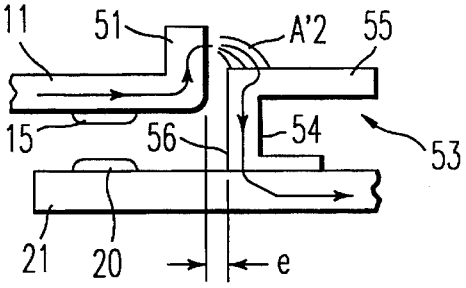

The operation of the FIG. 1 device is explained below with the aid of FIGS. 2 through 5. In the contacts closed position (FIG. 2) the finger 16 penetrates the recess 23. At the start of normal or electrodynamic contact opening (FIG. 12) a primary arc A1 appears between the contact pads 15, 20. When the distance between the contacts approaches the value e a secondary arc A2 fires in the ionization slot 25 between the faces 17 and 24 and/or in the slot 25*a*, the secondary arc A2 extending in the Y direction. As the opening of the contacts continues, the arcs A1, A2 co-exist and then the primary arc A1 is progressively extinguished so that only the arc A2 remains (FIG. 4). The chosen values of the slot width e, finger 16 length 1 and the related slot depth h are critical to achieving this substitution quickly and reliably. Thereafter (FIG. 5), the secondary arc A2 moves to A'2, leaving the ionization slot 25, and then jumps or migrates to the extinguishing plates 29 (A3). Conventional arc blow-out means 60 represented schematically in FIG. 1 help to encourage propagation of the plasma towards the slot 25 and of the pre-interruption arc A'2 towards the extinction chamber 28. These means can comprise the shape of the current feeds 11, 21, U-shape magnetic circuits around the contact area, etc.

The operation of the device from FIG. 10 is explained with reference to FIGS. 10 through 13.

Figure 11:
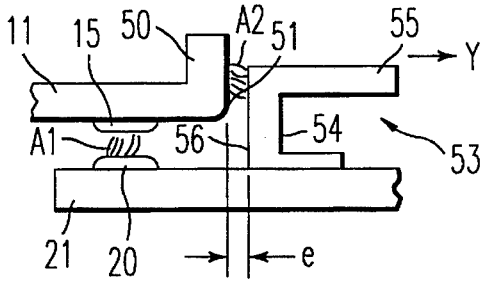
FIGS. 11 through 13 show various phases of opening of the contacts of the FIG. 11 device.
Figure 13:
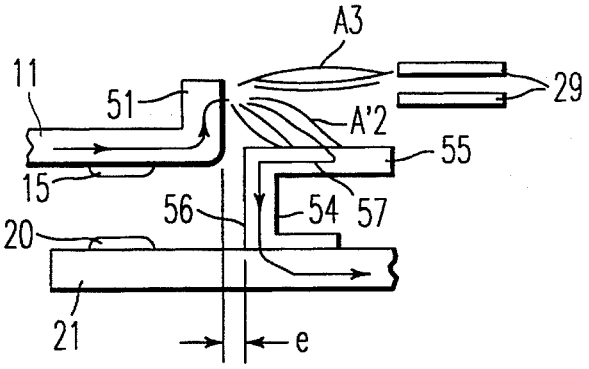

At the start of contact opening at nominal current or with a fault current (FIG. 11). A primary arc A1 fires between the contact pads 15, 20, and then, immediately afterwards and assisted by the diffusion of the plasma into the slot 25 of width e, a secondary arc A2 in the Y direction is struck between the vertical faces 51, 56. The arc A1 disappears but the arc A2 remains for a sufficient time period by virtue of temporary maintaining of the gap e as the travel between the contacts 15, 20 increases. The arc A2 then migrates to A'2 (FIG. 12) and its end where it joins onto the branch 55 of the J-shape switching part 53 is displaced towards the free end of this branch (FIG. 13). As a result the current flows in 57 in the direction opposite to X, which favors blowing out of the arc A'2.

The configuration of the part 53 can be modified in various ways known in themselves to accentuate this blow-out effect, for example by means of side flanges 58 (FIG. 13). The arc A'2 is finally switched towards the extinguishing plates (A3).

Figure 14:
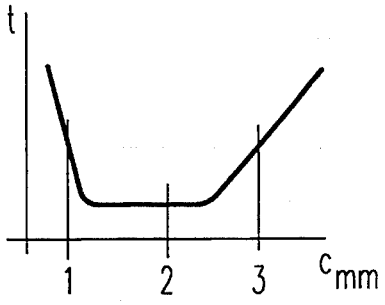
FIG. 14 shows the variation of the arc switching speed as a function of the width of the ionization slot.

FIG. 14 explains the arc switching time t for the arc A1, i.e. the time up to total disappearance of current between the pads 15 and 20, as a function of the width e of the ionization slot in millimeters, in a low-distribution voltage device.

In the device in accordance with the invention, apart from reduction of bonding of the contacts at the time of electrodynamic repulsion under a high current, wear of the contacts is reduced during AC4 type interruption maneuvers and contact resistance variations are reduced.

There is claimed:

1. Electromechanical switch of the contactor or circuit-breaker type comprising:

a fixed contact disposed on a conductive part;

a mobile contact disposed on a mobile conductive part, said mobile contact being separable from said fixed contact in an opening direction, wherein a primary arc fires between said contacts;

wherein, said fixed and mobile contact parts have respective first and second faces parallel or substantially parallel to said opening direction; and wherein said two faces are adjacent to said contacts and define between them, in a contact closed position, a narrow ionization slot, the width of said slot being maintained substantially constant at the beginning of contact opening in order to cause a secondary arc to fire substantially perpendicular to said opening direction.

2. The switch according to claim 1 wherein the width of said ionization slot is less than a critical electrodynamic contact opening distance.

3. The switch according to claim 2 wherein the width of said ionization slot is between approximately 1 mm and 3 mm.

4. The switch according to claim 1 wherein said ionization slot is narrow in a direction perpendicular to said opening direction and oriented in the lengthwise direction of said fixed and mobile contact parts and has in a median plane orthogonal to said opening direction a depth exceeding its width, means being provided for blowing out the arc in said direction perpendicular to said opening direction.

5. The switch according to claim 1 wherein at least one of said two faces is on a metal wear part interchangeably attached to the respective contact part.

6. The switch according to claim 1 wherein a recess defining said second face is formed in said fixed contact part and a right-angle upstand having said first face is provided at the free end of said mobile contact part, said upstand engaging in said recess when said contacts are closed.

7. The switch according to claim 6 wherein said right-angle upstand forms an arc horn directed towards an arc extinction chamber.

8. The switch according to claim 1 wherein said fixed contact part has a flat shape near said fixed contact and is joined to a switching branch having said second face, said branch determining with said flat fixed contact part a half-loop for the switched arc current, said second face being joined directly at right angles to said fixed contact part.

9. An electromechanical switch comprising:

a first conductive part;

a second conductive part, the first conductive part being movable with respect to the second conductive part;

a first contact fixed to the first conductive part;

a second contact fixed to the second conductive part facing the first contact;

a finger connected to the first conductive part forming an L-shaped member, perpendicular with the first conductive part, said finger extending toward the second conductive part, said finger being conductive;

a recess formed in the second conductive part for receiving the finger, wherein the finger does not contact a surface of the second conductive part within the recess;

wherein, when the switch is in a closed position, the first contact contacts the second contact and the finger is within the recess; and wherein, when the switch is open, the first contact and second contact disengage and a primary arc forms between the first and second contacts and, when a distance between the first and second contacts equals a distance between the finger and the side of the second conductive part, a secondary arc forms between the finger and the second conductive part, shunting the primary arc and decreasing the duration of the primary arc.

10. The electromechanical switch of claim 9, wherein the distance between the finger and the first conductive part within the recess is constant while the primary arc fires and is between 1 and 3 mm.

11. The electromechanical switch comprising:

a first conductive part;

a first contact fixed to the first conductive part;

a second conductive part, said first conductive part being movable with respect to said second conductive part;

a second contact fixed to the second conductive part and facing said first contact;

a finger connected to the first conductive part forming an L-shaped structure with the first conductive part, a surface of said finger adjacent a portion of the second conductive part being in a plane parallel to the plane of direction that the first conductive part moves with respect to the second conductive part;

wherein, a distance between said surface of said finger adjacent said portion of said second conductive part is constant while the switch is opened, the first and the second contacts disengage and a primary arc forms between the first and the second contacts; and wherein, a secondary arc forms between the finger and said adjacent portion of the second conductive part shunts the primary arc and reduces the duration of the primary arc.

12. The electromechanical switch of claim 11, wherein the finger is in a form of an arc horn.

13. The electromechanical switch of claim 11, wherein the portion of the second conductive part adjacent the finger is a branch extending in a perpendicular direction from a plane of the second conductive part.

14. The electromechanical switch of claim 11, further comprising:

a recess formed in the second conductive part, wherein the finger is inserted into the recess without touching the side of the second conductive part and said portion of the second conductive part adjacent the finger is a wall of the recess.

* * * * *